US008016020B2

(12) United States Patent
Poloni

(10) Patent No.: US 8,016,020 B2
(45) **Date of Patent: *Sep. 13, 2011**

(54) OSCILLATING TABLE

(75) Inventor: Alfredo Poloni, Fogliano Redipuglia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 402 days.

This patent is subject to a terminal disclaimer.

(21) Appl. No.: 12/224,140

(22) PCT Filed: Feb. 21, 2007

(86) PCT No.: PCT/EP2007/051680

§ 371 (c)(1),
(2), (4) Date: Aug. 18, 2008

(87) PCT Pub. No.: WO2007/096389

PCT Pub. Date: Aug. 30, 2007

(65) Prior Publication Data

US 2009/0014148 A1 Jan. 15, 2009

(30) Foreign Application Priority Data

Feb. 24, 2006 (IT) ..... MI2006A0334

(51) Int. Cl.
*B22D 11/053* (2006.01)

(52) U.S. Cl. ..... 164/416; 164/478

(58) Field of Classification Search ..... 164/416, 164/478

See application file for complete search history.

(56) References Cited

U.S. PATENT DOCUMENTS 5,642,769 A 7/1997 Thone et al.

FOREIGN PATENT DOCUMENTS

WO WP 99/12676 3/1999
WO WO 2006/010762 2/2006

*Primary Examiner* — Kuang Lin

(74) *Attorney, Agent, or Firm* — Stetina Brunda Garred & Brucker

(57) ABSTRACT

Oscillating table for thick slab production plants, comprising pairs of bars (8, 8', 9, 9'), lying on at least one horizontal plane, which constitute the elastic support elements of the ingot mould (3), thus permitting an optimal guiding of the oscillation thereof exclusively in the casting direction (x), said pairs of bars (8, 8', 9, 9') constituting a tie rod-strut system working in bending that confers to the table very high torsional and lateral stiffness. It allows a high ingot mould (3) guiding precision thus consenting, for example, wide oscillations exclusively in the axial casting direction.

17 Claims, 4 Drawing Sheets

OSCILLATING TABLE

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention refers to an oscillating table, specifically to an oscillating table of an ingot mould, used in plants for the production of metal products, such as thick slab, with a quadrangular section, having longitudinal sides with a length far greater with respect to the transverse sides.

2. State of the Art

Traditional oscillating tables for the production of thick slabs have been described in various patent documents.

Of these, the document U.S. Pat. No. 5,771,957 describes an oscillation device for the continuous casting of thick slabs comprising an ingot mould suited to oscillating in the casting direction. This ingot mould is mounted on springs that act as guiding elements, blocked at both ends to fixing supports of a support structure fixed to the ground. Specifically, it provides two pairs of springs that extend transversely to the casting direction, each pair being arranged on a vertical plane parallel to the narrow sides of the ingot mould. The ingot mould is made to oscillate thanks to the connection thereof with hydraulic oscillation means, arranged below each of the pairs of springs. Such hydraulic means are fixed at one end to the fixed support structure, and at the other end they act on part of the ingot mould that constitutes the fixing block of the same ingot mould to the springs.

Disadvantageously, in order to assure a high guiding precision of the ingot mould and therefore avoid other types of movement outside the oscillation motion in the casting direction only, this oscillation device or oscillating table provides a cumbersome structure and a high overall weight. For example, it is necessary to use springs of considerable dimensions to avoid any movement of the ingot mould in the longitudinal direction, defined as the horizontal direction parallel to the long sides of the ingot mould.

Furthermore, springs, fixing block of the ingot mould to said springs and the same support structure have considerable encumbrance and weight also to prevent roll movements on both the longitudinal plane, parallel to the long sides of the ingot mould, and on the transverse plane, parallel to the short sides of the ingot mould, which could be caused by parallel moments acting on the aforesaid planes respectively. Only with these features it is in fact possible to avoid deviations and displacements of the ingot mould from the guiding trajectory desired.

A further disadvantage of this oscillating table is therefore that of necessitating higher actuation forces, i.e. of a large dimension oscillation control. Furthermore, the duration of the springs is limited due to the high alternated flexion stresses that result due to the high inertia.

The need is therefore felt to provide an innovative oscillating table for thick slabs that makes it possible to overcome the above drawbacks.

SUMMARY OF THE INVENTION

The primary aim of the present invention is to provide an oscillating table for thick slab production plants that presents a high torsional and lateral stiffness and that allows a high ingot mould guiding precision despite having an overall weight and an encumbrance considerably lower than the known oscillating tables dedicated to thick slab production.

The present invention, therefore, proposes to achieve the abovementioned aim and to resolve the drawbacks discussed above by providing an oscillating table for plants for the continuous casting of a thick slab with a quadrangular section having a longitudinal side with a length far greater with respect to a transverse side that, according to claim 1, comprises a support structure, solidarity fixed to the ground, supporting an ingot mould comprising a continuous casting mold having a quadrangular section defining a casting direction of said thick slab, wherein said ingot mould can be guided in an oscillation by first elastic means arranged transverse to the casting direction, actuation means suited to transmitting alternating impulses, in a substantially vertical direction, to the ingot mould, in order to cause the oscillation motion thereof, characterized by the fact that said first elastic means comprise a plurality of pairs of first elastic bars and a plurality of pairs of second elastic bars, said pairs of first bars being arranged alternatively substantially on two first planes parallel to one another and to the casting direction, and said pairs of second bars being arranged alternatively substantially on two second planes parallel to one another and to the casting direction, said second planes being substantially perpendicular to said first planes in order to give the table a predetermined torsional stiffness around the casting direction and a predetermined lateral stiffness in directions orthogonal to the casting axis and to allow the oscillation of the ingot mould in the casting direction only.

Advantageously, the particular configuration of the centering and guiding elements of the ingot mould, preferably pairs of round or flattened shaped elastic bars, allows an optimal guiding of the oscillation thereof exclusively in the casting direction. Roll movements are therefore excluded around axes perpendicular to the casting axis, which could be generated by a torsional moment, thanks to the combined action of the pairs of bars as tie rods and struts working in bending. Furthermore, such bars make it possible to obtain a high lateral stiffness of the ingot mould and of the optional intermediate mobile structure between fixed structure and ingot mould.

The oscillating table of the invention, in addition to guaranteeing a very high torsional and lateral stiffness, also makes it possible to obtain the following advantages:

a low inertia as the organs in movement and the weight thereof are reduced to a minimum;

a low overall weight that is within an interval of between 10 and 20 tonnes, and therefore a weight at least halved with respect to a traditional table for thick slab casting;

the possibility of operating with greater oscillations with respect to the tables provided with large springs, fixed at both ends to the fixed frame, wherein the stroke allowed to the ingot mould by these springs is further limited;

the possibility of oscillating in curve following an arc with a circumference corresponding to a predetermined radius, i.e. of housing molds or curved moulds, thanks to the possibility of installing part of the guiding elements in a inclined way with respect to a horizontal plane with a common axis of rotation.

Advantageously, the oscillating table of the invention is simple to manufacture and does not provide mechanical organs subject to wear, such as, for instance, bearings, rotating pins, joints, runners, etc., so as to eliminate the need for maintenance and obtain a substantial saving of time and money.

A further advantage is represented by the fact that the hydraulic movement cylinders or mechanical movement means are connected to the fixed structure and to the ingot mould or to the intermediate mobile structure between said fixed structure and said ingot mould with interlocking leaf springs and not with pins or other mechanical organs, for example bearings or joints, which would involve maintenance operations. The complete absence of rotating organs in the oscillating table of the invention thus makes it possible to eliminate all the undesired movements due to the clearances, the value of which would be amplified over time, given the high oscillation frequencies.

The dependent claims describe preferred embodiments of the invention.

BRIEF DESCRIPTION OF THE FIGURES

Further characteristics and advantages of the invention will be further evident in view of the detailed description of preferred, though not exclusive, embodiments of an oscillating table, such as illustrated by way of non limiting example with the aid of the appended drawings wherein.

DETAILED DESCRIPTION OF PREFERRED EMBODIMENTS OF THE INVENTION

Figures from 1 to 3 illustrate three embodiments of the oscillating table, object of the present invention, globally indicated with reference 1, for the oscillation of ingot moulds for thick slabs, i.e. ingot moulds that have particularly massive dimensions with respect for example to the ingot moulds for billets and blooms.

Figure 1:
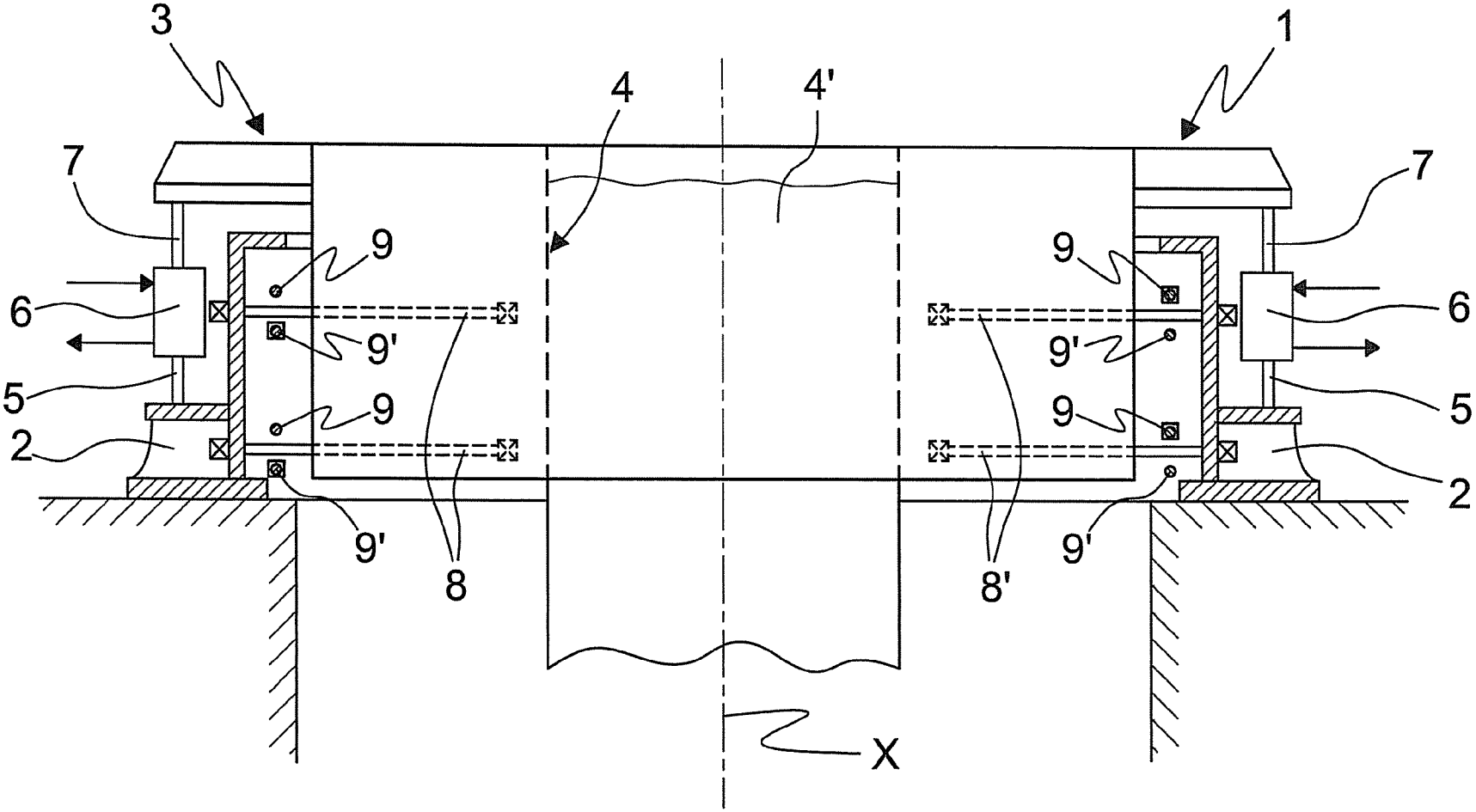
FIG. 1 represents a longitudinal section of a first embodiment of the oscillating table according to the invention.

The first embodiment of the table 1, illustrated in FIG. 1, comprises an external load-bearing structure 2 or first structure or support frame, fixed to the ground. The external load-bearing structure 2 cooperates with an ingot mould 3 comprising a continuous casting mold 4 for the continuous casting of metal products or ingots with a quadrangular section, such as thick slabs, having longitudinal sides 4' of a length far greater with respect to the transverse sides 4" (shown in FIG. 2*b*). Said longitudinal sides define longitudinal planes and said transverse sides define transverse planes.

The oscillation movement at the ingot mould 3 is given by an oscillation control, comprising for example a pair of actuation means 5, such as hydraulic cylinders or mechanical means constituted for example by a motor plus a connecting rod-crank system. These actuation means 5 are connected at one end thereof to the load-bearing structure 2, fixed to the ground, with first elastic springs working in bending, such as interlocking leaf springs 6, and are connected at the other end thereof to the ingot mould 3, as a mobile element, with second elastic springs working in bending such as interlocking leaf springs 7. As in a such oscillation control there is a complete absence of bearings, pins, joints and other mechanical organs, one eliminates the clearance of such components, which are notoriously subject to wear requiring frequent maintenance operations.

In order to avoid deviations of the ingot mould 3 from the desired trajectory, preferably that one along the casting direction or axis X defined by the same ingot mould, there are provided elastic guiding elements 8, 8', 9, 9' of the ingot mould 3, housing in the central cavity thereof the continuous casting mold 4, closely fixed thereto by means of hydraulic brackets or other mechanical means not shown in the figures.

Such guiding elements 8, 8', 9, 9', for example in the form of interlocking round or flattened elastic bars, are arranged as illustrated, for example, in FIG. 1.

In this preferred embodiment such elastic guiding means advantageously comprise four pairs of first elastic bars 8, 8' and four pairs of second elastic bars 9, 9'. The number of pairs of the first and second bars may also be different but is, in any case, an even number.

The four pairs of the first elastic bars 8, 8' are arranged in pairs respectively on two longitudinal vertical planes, parallel to one another and to the casting axis X and equidistant from said axis. Similarly, the four pairs of the second elastic bars 9, 9' are arranged in pairs respectively on two transverse vertical planes, parallel to one another and to the casting axis X and equidistant from said axis; said transverse planes being substantially perpendicular to said longitudinal planes.

The bars 8, 8', 9, 9', such as for example round bars or bars of other sections with a substantially flattened shape, such as, for example, rectangular, are fixed at a first end thereof to the external structure of the ingot mould 3, i.e. to the mobile part of the oscillating table, and at the second end thereof they are fixed to the external load-bearing structure 2 or first support structure, such as a box type frame fixed to the ground. The systems for fixing the bars to the ingot mould 3 are constituted, for example, by brackets welded to said ingot mould that present passing holes in which the bars are inserted; the ends of such bars are threaded and their locking on the brackets takes place by means of nuts.

The fixing of the bars to the external load-bearing structure 2 can be performed with similar systems, i.e. by means of introduction of the threaded end of the bars into the thickness of the structure and locking thereof with nuts.

On each of these longitudinal and transverse vertical planes, the distance between the upper pair of bars, arranged in the proximity of the ingot mould head, and the lower pair, arranged in the proximity of the mold feet, is advantageously the same. The first elastic bars 8, 8' are parallel to one another, as are the second elastic bars 9, 9'.

The elastic bars are arranged so as to be stiff to bending in the transverse directions with respect to the casting or oscillating direction X and flexible in direction X only.

One embodiment provides the use of leaf springs or similar springs as elastic guiding means of the ingot mould 3.

Advantageously, the fact that on each of said longitudinal and transverse vertical planes each of the elastic bars 8, 8', 9, 9' of each pair presents the first end fixed to the mobile part of the table and the second end fixed to the fixed part in the opposite way with respect to the corresponding ends of the immediately adjacent bar of the same pair, together with the fact that the arrangement of the pairs of bars 9, 9' respectively corresponding on the transverse planes is asymmetrical with respect to the casting direction or axis X (as shown by observing the bars 9, 9' in FIG. 1), makes the oscillation of the ingot mould 3 only possible along the direction of the casting axis X.

Being an application on an ingot mould for thick slabs, which has particularly massive dimensions with respect to, for example, the ingot moulds for billets and blooms, advantageously the longitudinal extension of the first bars 8, 8' is deter-mined in such a way as to prevent an excessive alternate bending of such bars on the longitudinal planes. Furthermore, the systems for fixing said first bars to the ingot mould 3 are preferably arranged in correspondence with the transverse sides of the continuous casting mold 4. Unlike the second elastic bars 9, 9' of each pair, which in the longitudinal extension thereof on the transverse planes present a predetermined overlap, the first elastic bars 8, 8' of each pair do not present any overlap along the longitudinal extension thereof and their internal ends are spaced by a distance equal to approximately the length of the longitudinal sides 4' of the mould 4.

Such configuration of the pairs of elastic bars 8, 8', 9, 9' makes it possible to contrast each torsion moment that could occur parallel to the casting direction X. According to the sense of this torsion moment, half of the bars will be subject to traction, acting as tie rods, whereas the other half will be subject to compression, acting as struts.

Figure 2A:
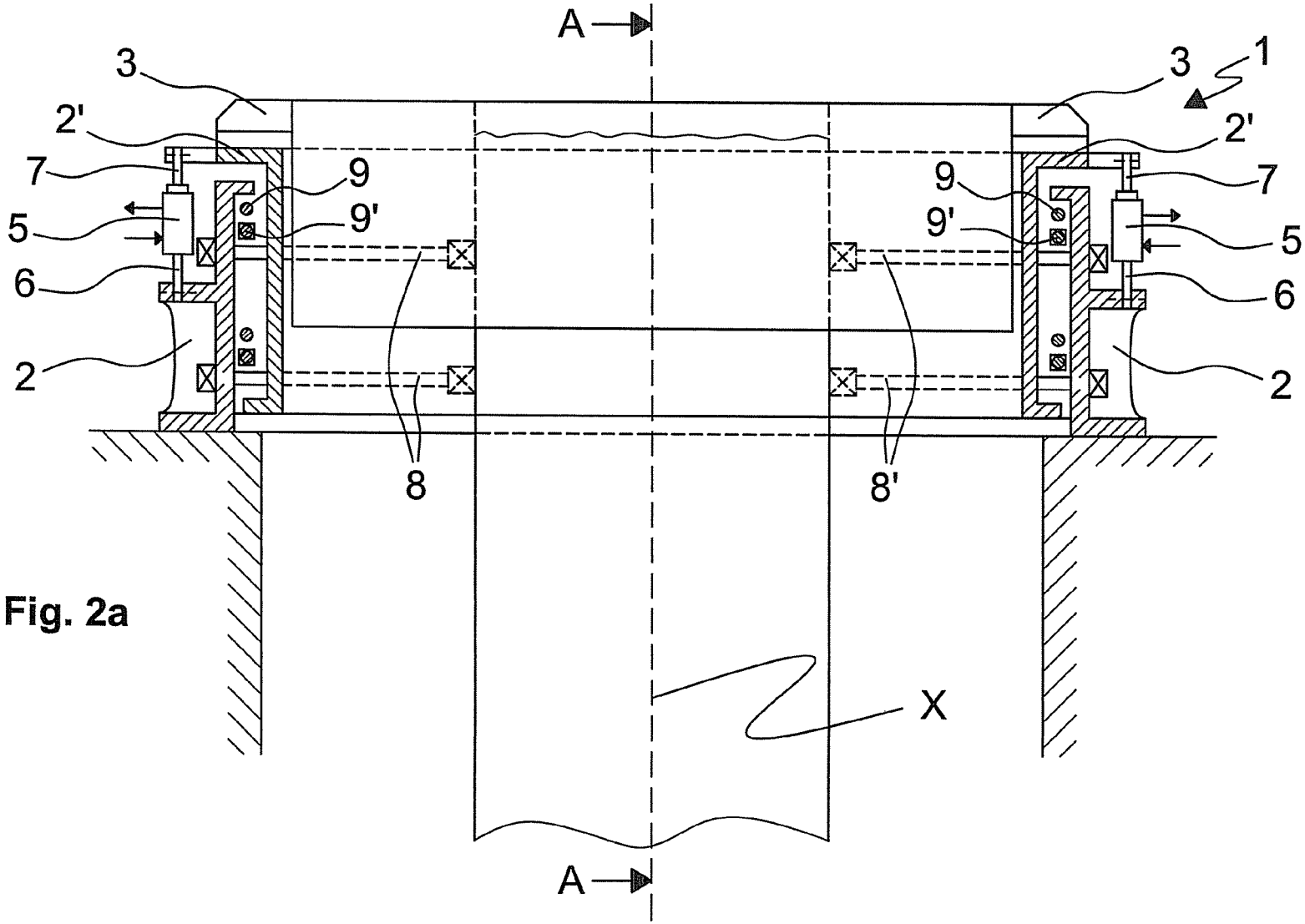
FIG. 2*a* represents a longitudinal section of a second embodiment of the oscillating table according to the invention.
Figure 2B:
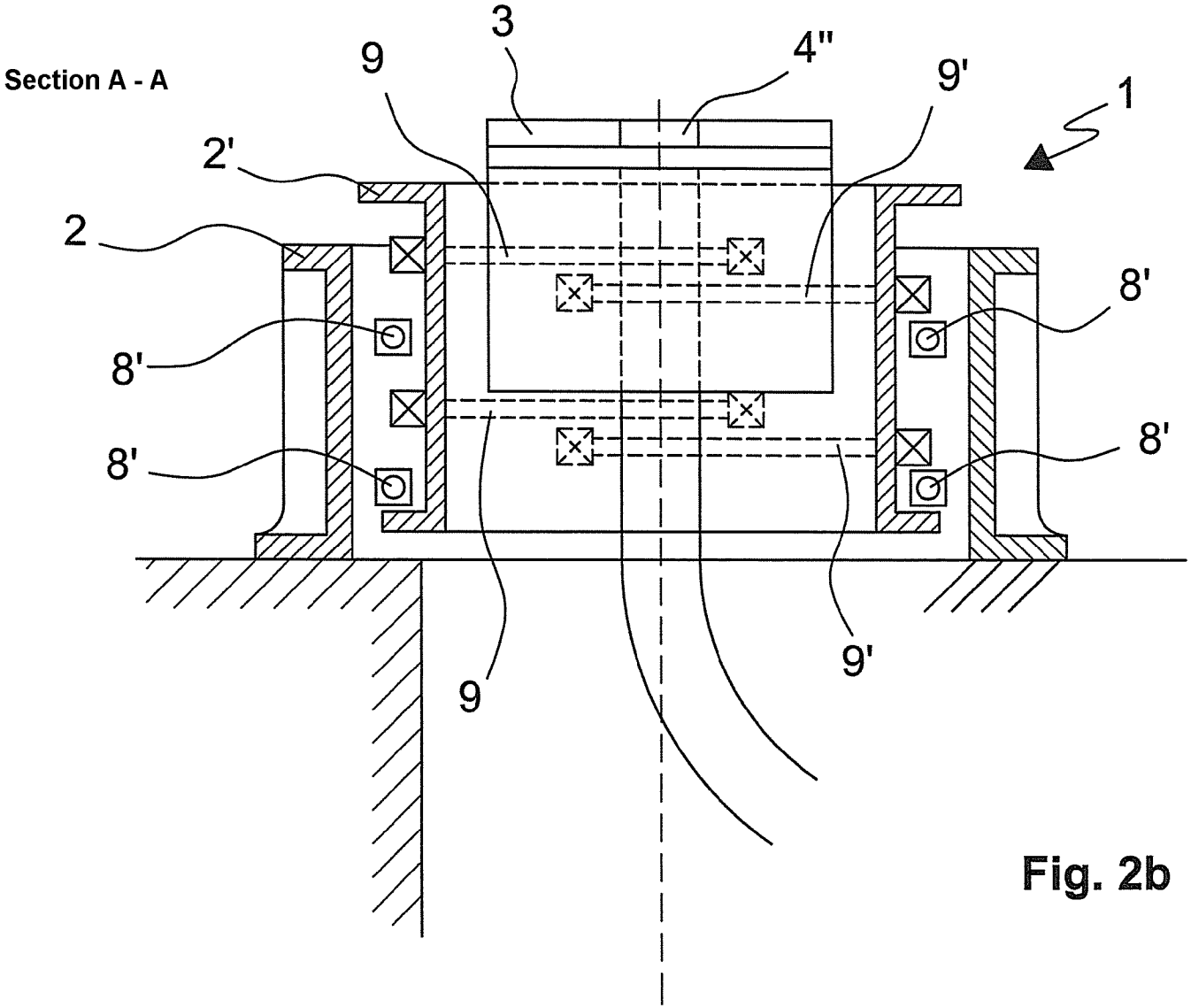
FIG. 2*b* represents a section along the A-A plane of the second embodiment of FIG. 2*a;*

Advantageously, such a configuration of the oscillating table reduces the weight to just 10 tonnes, against the 40 tonnes of a conventional table of the known art. A second embodiment of the oscillating table, object of the present invention, is illustrated in FIGS. 2*a* and 2*b*.

Unlike the first embodiment, with the external load-bearing structure 2, fixed to the ground, a second mobile support structure or frame 2' cooperates and is suited to housing in the interior thereof the ingot mould 3 comprising the continuous casting mold 4 for the continuous casting of thick slabs, having longitudinal sides 4' of a length far greater with respect to the transverse sides 4". In this case, the oscillation movement is given to the second mobile support structure 2' and, therefore, to the ingot mould 3 by an oscillation control comprising, for example, one pair or several pairs of the above-mentioned actuation means 5. The actuation means 5, for example hydraulic cylinders or mechanical means, are connected at a first end thereof to the load-bearing structure 2 fixed to the ground with first elastic springs working in bending, such as interlocking leaf springs 6, and are connected at the second end thereof to the second support structure 2', as a mobile element, with second elastic springs working in bending, such as interlocking leaf springs 7.

The pairs of elastic elements 8, 8', 9, 9', such as bars of various sections, again arranged on longitudinal and transverse vertical planes substantially perpendicular to one another and parallel to the casting direction X, act in this case as a guide of the mobile support structure 2' of the ingot mould 3.

The fixing systems of the elastic bars are constituted, for example, by brackets welded respectively to the external load-bearing structure 2 and to the mobile structure 2'. Such brackets have passing holes in which the bars are inserted, the ends of such bars are threaded and their locking onto the brackets takes place by means of nuts. The fixing systems for fixing the ends of the first bars 8, 8' to the mobile structure 2' are preferably arranged in correspondence with the transverse sides of the continuous casting mold 4.

With this configuration of the oscillating table, which provides the ingot mould 3 arranged inside the second mobile support structure or frame 2', the overall weight of the oscillating table is around 20 tonnes, i.e. a weight in any case halved with respect to the traditional tables.

Figure 3:
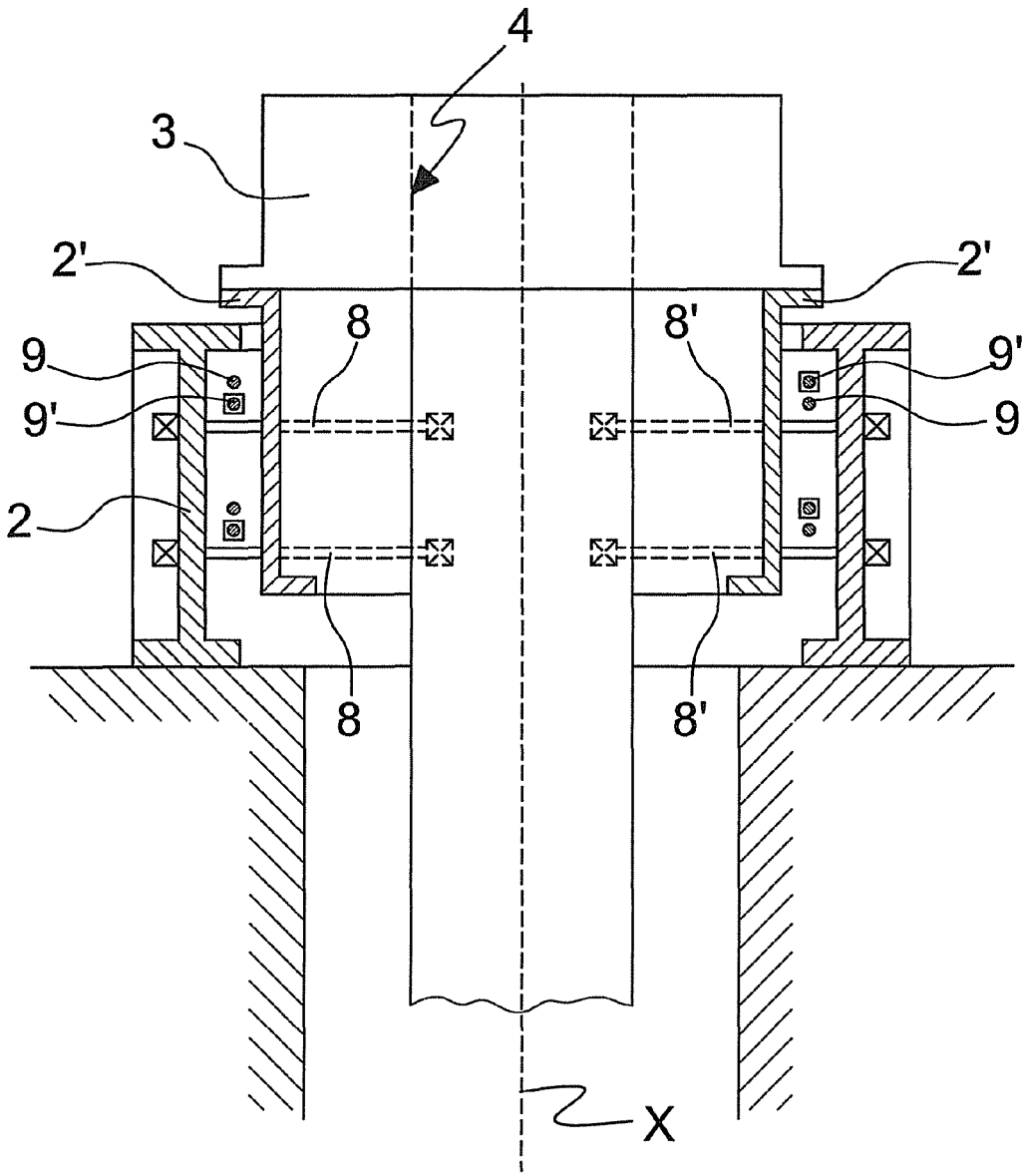
FIG. 3 represents a longitudinal section of a third embodiment of the oscillating table according to the invention.

A third embodiment of the oscillating table, object of the present invention, is further illustrated in FIG. 3. Unlike the second embodiment, the ingot mould 3 is not arranged inside the second mobile support structure or frame 2' but rests on top of it, with the advantage of a smaller encumbrance of the entire oscillating table 1 in terms of the width both along the longitudinal plane and along the transverse plane.

One variant of the three embodiments of the oscillating table of the invention provides that each of the four pairs of second elastic guiding elements 9, 9', provided on the two transverse vertical planes, for example in the form of interlocking elastic round or flattened bars, may have a predetermined inclination, equal in absolute value but opposite in sign to the other pair on the same transverse plane, with respect to a horizontal plane perpendicular to the casting direction X. On each transverse vertical plane, the two pairs of second elastic bars 9, 9' respectively have an ideal intersection point that defines a common centre of rotation. The two centers of rotation, one for each transverse plane, are arranged on an axis of rotation lying on said horizontal plane and perpendicular to the casting direction or axis X in order to allow the oscillating movement of the table following a circumference arc corresponding to a predetermined radius of curvature.

In general the pairs of the second elastic bars 9, 9' on each transverse vertical plane are not parallel to one another; they may present different inclinations to one another and their ideal intersection point defines a common ideal centre of rotation.

In the same way as described above, the four pairs of first elastic bars 8, 8', arranged in pairs respectively on two longitudinal vertical planes, are on the other hand arranged horizontally and are all parallel to one another.

Also in this variant with the second bars 9, 9' inclined and not parallel to one another, the oscillation of the ingot mould 3 is only possible along the direction of the casting axis X, following a circumference arc corresponding to a predetermined radius of curvature, substantially equal to the radius of curvature of the continuous casting mold or curved mould or of a different value.

In all the embodiments of the oscillating table of the invention, the use of significantly simplified elastic guiding elements and the particular configuration thereof thus allows a very high continuous casting mold guiding precision and a considerable reduction in the oscillation marks on the cast product. The precision of the oscillation movement is guaranteed also in the case of differentiated thrust of the actuation means 5: in fact the movement remains in any case synchronised and "parallel" by effect of the tie rod-strut phenomenon, except for the yielding in the elastic field of the round bars.

Advantageously, the set of tie rods and struts constitutes a completely maintenance free anti-roll system that:

does not allow any movement in a longitudinal direction;

does not allow any movement in a transverse direction;

does not allow any rotation on the longitudinal plane;—does not allow any rotation on the transverse plane;

only allows the axial movement of vertical oscillation in the direction X.

The oscillating table, object of the invention, also allows, thanks to the improvements described above, a greater compactness and constructive simplicity and an operation at oscillation frequencies of over 6 Hz, higher than the normal frequencies equal to 4 Hz.

Given the compactness and the lower weight of the mobile part of the table of the invention, it is not necessary to provide further elastic means, for example compression or air or leaf springs, with the function of lightening the weight of the structure thereof.

The particular embodiments described herein do not restrict the scope of this application, which covers all the variants of the invention defined in the claims.

The invention claimed is:

1. A casting apparatus for the continuous casting of a thick slab with a quadrangular section having a longitudinal side of a length far greater with respect to a transverse side, comprising an ingot mold comprising a quadrangular mold cavity having a longitudinal axis X defining a casting direction, and an oscillating table comprising a load bearing structure, solidarily fixed to the ground, supporting said ingot mold, wherein said ingot mold is capable of being guided in an oscillation by a plurality of first and second pairs of elastic bars arranged transverse to the longitudinal axis X, actuation means suited to transmit alternating impulses, in a substantially vertical direction, to the ingot mold, in order to cause the oscillation motion thereof, said elastic bars comprising the plurality of first pairs of elastic bars arranged alternately substantially on two first planes parallel to one another and to the longitudinal axis X, equidistant from said longitudinal axis X, and on opposite sides of the longitudinal axis X, wherein the plurality of second pairs of elastic bars is arranged alternatively on two second planes parallel to one another and to the longitudinal axis X, equidistant from said longitudinal axis X, and on opposite sides of the longitudinal axis X, wherein, on each of said first and second planes, each elastic bar of each first and second pairs of elastic bars has a first end fixed to the ingot mold and a second end fixed to the load bearing structure, and wherein said second planes are substantially perpendicular to said first planes in order to give the table a predetermined torsional stiffness around the longitudinal axis and a predetermined lateral stiffness in directions orthogonal to the longitudinal axis and to allow the oscillation of the ingot mold in the casting direction only wherein inner ends of the first elastic bars of each pair are spaced by a distance equal to approximately the length of the longitudinal sides of the mold cavity section.

2. The apparatus according to claim 1, wherein the second pairs of elastic bars respectively corresponding on the second planes are arranged asymmetrical with respect to the longitudinal axis X.

3. The apparatus according to claim 2, wherein only the first ends of the second elastic bars of each pair overlap one another along the extension thereof on said second planes and the second ends of the second elastic bars are fixed to opposing sides of the load bearing structure.

4. The apparatus according to claim 3, wherein said actuation means are connected at one end thereof to the load-bearing structure, fixed to the ground, through first elastic springs working in bending.

5. The apparatus according to claim 4, wherein the number of pairs respectively of first and second elastic bars is even.

6. The apparatus according to claim 5, wherein said elastic bars have a round or flattened rectangular section.

7. The apparatus according to claim 4, wherein said actuation means are connected at the other end thereof to the ingot mold, as a mobile element, through second elastic springs working in bending.

8. The apparatus according to claim 6, wherein between said ingot mold and said load bearing structure, fixed to the ground, there is provided a mobile structure suited to supporting the ingot mold and to being guided in an oscillation by the pairs of first and second elastic bars.

9. The apparatus according to claim 8, wherein each of the elastic bars of each pair provides a first end fixed to the mobile structure and a second end fixed to the load bearing structure.

10. The apparatus according to claim 9, wherein said actuation means are connected at the other end thereof to the mobile structure through second elastic springs working in bending.

11. The apparatus according to claim 10, wherein the ingot mold is housed inside said mobile structure.

12. The apparatus according to claim 10, wherein the ingot mold is housed on said mobile structure.

13. The apparatus according to claim 7, wherein the pairs of the second elastic bars are parallel to one another.

14. The apparatus according to claim 10, wherein the pairs of the second elastic bars are parallel to one another.

15. The apparatus according to claim 7, wherein the pairs of the second elastic bars on each second vertical plane are convergent and their ideal intersection point defines a common ideal centre of rotation.

16. The apparatus according to claim 10, wherein the pairs of the second elastic bars on each second vertical plane are convergent and their ideal intersection point defines a common ideal centre of rotation.

17. The apparatus according to claim 1 wherein the two first planes are perpendicular to the two second planes.

* * * * *